US005966295A

United States Patent [19]

Park

[11] Patent Number: 5,966,295

[45] Date of Patent: Oct. 12, 1999

[54] CONVERTIBLE FLUSH OR EXPOSURE TYPE TERMINAL BOARD OF CONTROL DEVICE

[75] Inventor: Hwan Ki Park, Pusan, Rep. of Korea

[73] Assignee: Autonics Corporation, Pusan, Rep. of Korea

[21] Appl. No.: 08/563,731

[22] Filed: Nov. 28, 1995

[30] Foreign Application Priority Data

Dec. 27, 1994 [KR] Rep. of Korea ..... 94-36409

[51] Int. Cl.[6] ..... H01R 9/00

[52] U.S. Cl. ..... 361/823; 361/824; 439/709

[58] Field of Search ..... 361/822, 824, 361/644, 651, 656; 439/709, 712, 573; 174/59

[56] References Cited

U.S. PATENT DOCUMENTS 5,215,480 6/1993 Lesslie et al. ..... 439/709

FOREIGN PATENT DOCUMENTS 3166793 7/1991 Japan .
3221914 9/1991 Japan .
3308543 10/1991 Japan .
4274140 10/1992 Japan .
4310911 10/1992 Japan .
91 11891 7/1991 Rep. of Korea .

*Primary Examiner*—Leo P. Picard
*Assistant Examiner*—Phuong T. Vu
*Attorney, Agent, or Firm*—Greer, Burns & Crain Ltd.

[57] ABSTRACT

A terminal board for attachment to a control device in one of a flush or exposed type configuration. The terminal board including at least one exposed fixing hole defined in an upper portion of the terminal board, and at least one attached plate fixing hole defined in a lower portion of the terminal board, wherein the terminal board may be mounted to the control device in an exposure type attachment configuration in which the exposed fixing hole is exposed relative to the case. Alternatively, the terminal board may be mounted to the control device in an flush type attachment configuration in which the exposed fixing hole is flush with the case of the control device.

1 Claim, 4 Drawing Sheets

CONVERTIBLE FLUSH OR EXPOSURE TYPE TERMINAL BOARD OF CONTROL DEVICE

BACKGROUND OF THE INVENTION

The present invention relates to a convertible flush or exposure type terminal board of control device which can be assembled convertibly either in a flush type being simply adhered to the front case of control box or in an exposure type being attached inside the case of control box, according to its uses.

As a control device being mostly utilized in industrial fields, products having a display function or an input setup function are widely used, and such products include a terminal board connecting a front plate with the wiring of input and output on the principal axis of the case.

Further, even a product having the same function uses a terminal board having a different shape, i.e. an exposure type being attached to the inside of control box or a flush type being attached to the front surface of control box, according to its uses.

Accordingly, in case of the conventional control device, the possible wiring connection of input and output used by a driver required the flush type of terminal board for adhesion to the front panel, and for adhesion to the plate in the middle of the panel inside, only the exposure type of terminal board enabled convenient wiring connection by using a driver from the side of front surface. Consequently, it had the drawbacks which two kinds of products having the same function should be made.

SUMMARY OF THE INVENTION

An object of the present invention for settling the aforesaid drawbacks is to provide a convertible flush or exposure type terminal board of control device having an integrated structure enabling it to be easily adapted for either flush type or an exposure type mounting configuration according to its uses.

To accomplish such object, a convertible flush or exposure type terminal board of control device according to the present invention is provided with at least one exposed fixing hole on an upper surface, and at least one attached plate fixing hole on a lower surface thereof.

This and other objects and novel features of the present invention will become more apparent from the following description when taken in conjunction with the accompanying drawings.

DESCRIPTION OF THE PREFERRED EMBODIMENT

Hereinafter, the present invention will be described in detail with reference to the accompanying drawings.

Figure 1A:
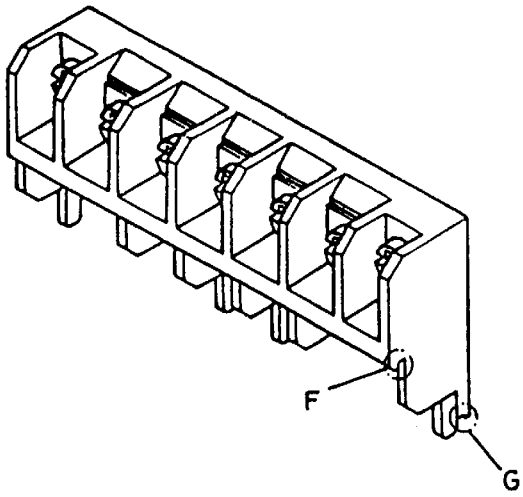
FIG. 1 is a perspective view illustrating a terminal board of control device according to an embodiment of the present invention.
Figure 1B:
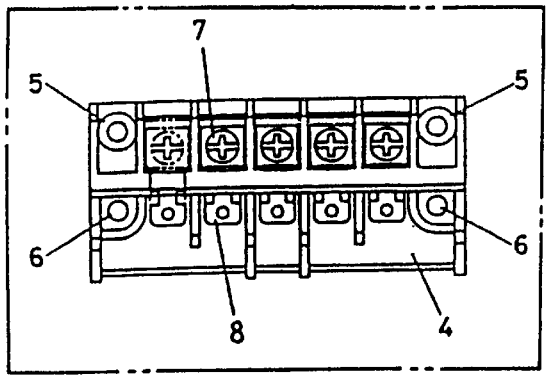
Figure 1C:
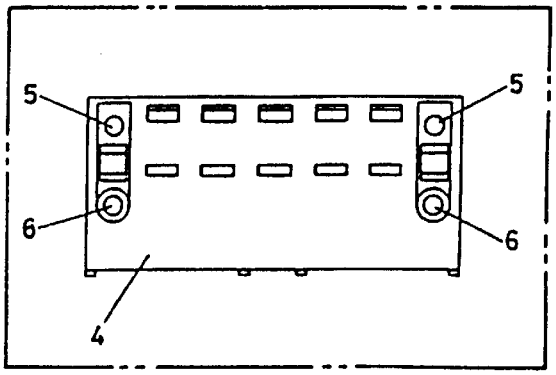

FIG. 1 illustrates a terminal board of control device according to an embodiment of the present invention. The convertible exposure or flush type terminal board according to the present invention includes an attached plate fixing hole 5 and an exposed fixing hole 6 respectively defined in the top and bottom portions of terminal board 4. The exposed fixing hole 6 can be easily converted to an exposure type being attached to the rear surface of a case of control device 9 by using a fixing bolt 6A as shown on FIG. 2(B), and the fixing hole of attached plate 5 can be converted to a flush type being attached to the front surface of the case of control device 9 by using a fixing bolt 5A as shown on FIG. 3(B), thereby enabling to perform the aforesaid two functions with one main body of terminal board 4.

Namely, the terminal board 4 is mounted to the control device 9 using bolts (5A, 6A) via at least one of the exposed fixing hole 5 and the attached plate fixing hole 6.

Figure 4A:
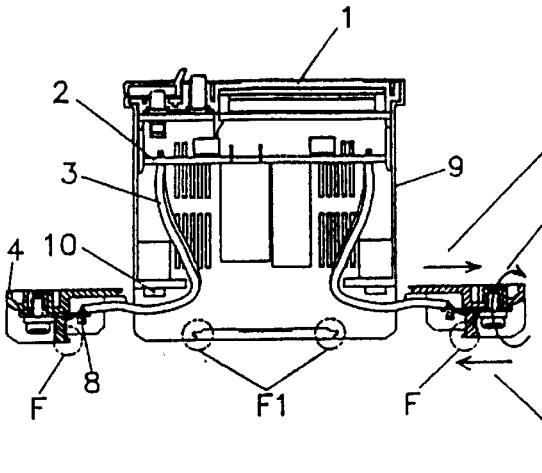
FIG. 4 is a sectional view for installing an exposure type or a flush type of terminal board according to the present invention.
Figure 4B:
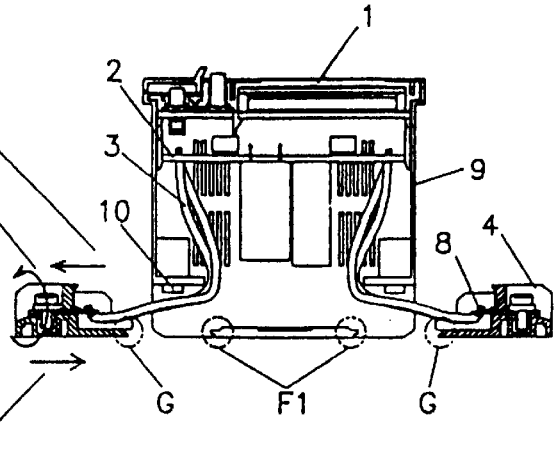

Accordingly, the terminal board 4 has a short projection (F) for engaging with an upper portion of the case of the control device 9, and a long projection (G) for engaging with a lower portion of the case. As shown in FIG. 4, the projections F,G are note visible when the terminal board is mounted to the control device.

Figure 2A:
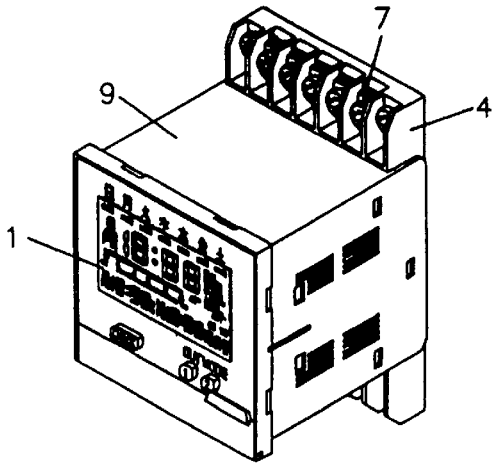
FIG. 2 is a view illustrating the terminal board according to the present invention which is assembled to the case of control device in an exposure type.

FIG. 2 is a view illustrating the terminal board according to the present invention which is assembled to the case of control device in an exposure type. In case of assembling the exposure type of control device, the main body of terminal board 4 is attached to the rear side opposed to a front plate 1 of the case of control device 9 as shown on FIG. 2(A). Inserting the main body of terminal board 4 in "D" direction as shown on FIG. 4(*b*), the projection(G) is engaged with the engaging position (F1) of the case(G) each other and a flexible wiring 3 is connected with a base plate 2 and the terminal pin 8 of the main body of terminal board 4.

Figure 2B:
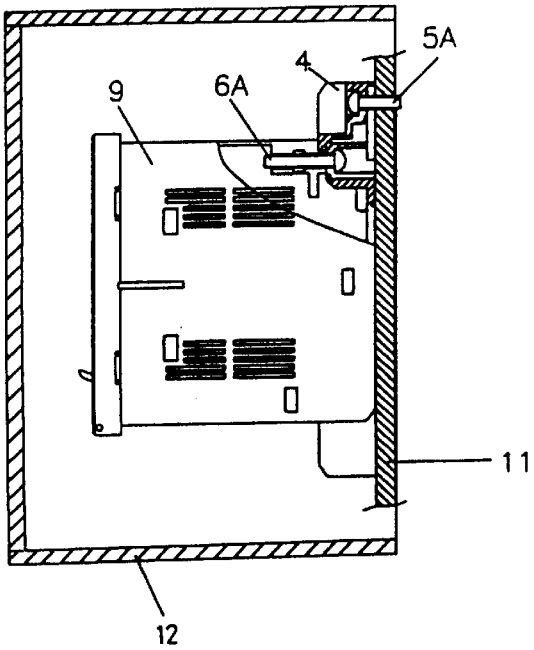

Accordingly, the respective exposed fixing hole 6 of the main body of terminal board 4 and the terminal fixing hole 10 of the case 9 meet so that the fixing bolt 6A can be put together as shown on FIG. 2(B).

Figure 2C:
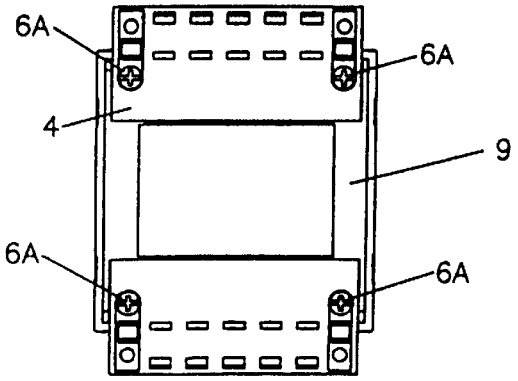

The fixing hole of attached plate 5 of the main body of terminal board 4 is used for fixing the case of control device 9 on an attached plate 11 inside a control box 12 as shown on FIG. 2(C), and such exposed fixing hole can be converted into a flush type by unfastening said fixing bolts 5A, 6A with a driver, taking out the main body of terminal board 4 connected with flexible wiring 3 together with the wiring 3, turning inside out, and putting in again to assemble.

Namely, to change the exposure type into the flush type, take out in "C" direction as shown on FIG. 4 and insert in "D" direction by turning the main body of terminal board 4 in "E" direction after loosening the previously fastened fixing bolts 5A, 6A, and fasten the fixing bolt 5A on the fixing hole of attached plate 5. Then, it becomes the flush type of control device as shown on FIG. 3(B).

Figure 3A:
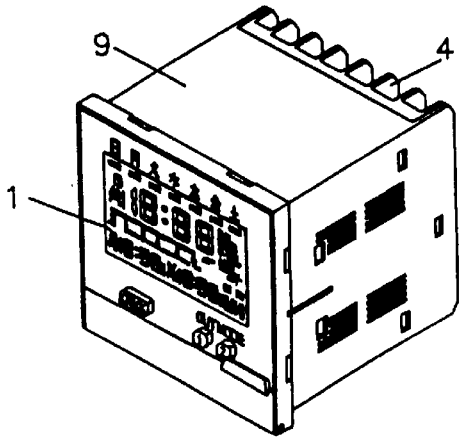
FIG. 3 is a view illustrating the terminal board according to the present invention which is assembled to the case of control device in a flush type.

FIG. 3 is a view illustrating the terminal board according to the present invention which is assembled to the case of control device in a flush type. In case of assembling the flush type of control device, the main body of terminal board 4 is attached to the rear side opposed to the front plate 1 of the case of control device 9 as shown on FIG. 3(A). Inserting the main body of terminal board 4 in "D" direction as shown on FIG. 4(A), the projection(F) is engaged with the engaging position(F1) of the case 9 each other and thus flexible wiring 3 is connected with the base plate 2 and the terminal pin 8 of the main body of terminal board 4.

Figure 3C:
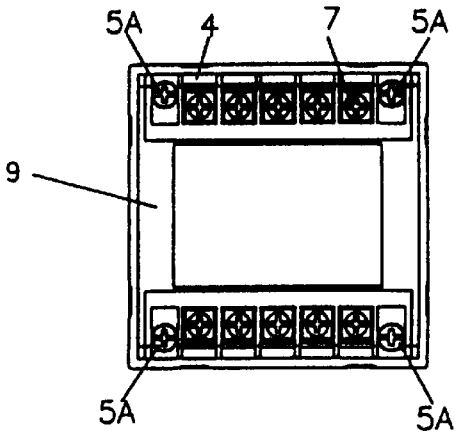
Figure 3B:
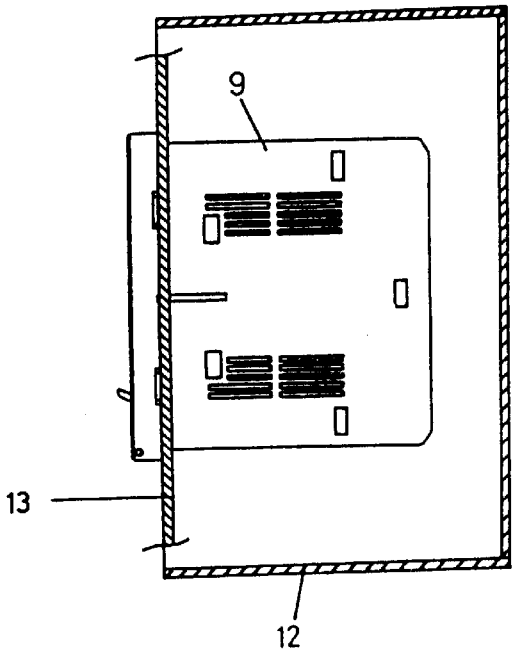

Accordingly, the respective fixing hole of attached plate 5 of the main body of terminal board 4 and the terminal fixing hole 10 of the case 9 meet each other so that the fixing bolt 5A can be put together as shown on FIG. 3(B).

The case of control device 9 of the main body of terminal board 4 is used for fixing a front attached plate 13 of the control box 12 on its front as shown on FIG. 3(C), and such flush type can be converted into an exposure type by unfastening said fixing bolt 5A with a driver, taking out the main body of terminal board 4 connected with flexible wiring 3 together with the wiring 3, turning

I claim:

1. A terminal board assembly which is convertibly mounted to a case of a control device in one of an exposed-type mounting position and a flush-type mounting position, said terminal board assembly comprising:

a terminal board having a body portion having plural conductive terminals, said terminal board having first and second horizontal ends and first and second vertical ends;

a first fixing hole for exposed-type mounting being defined through at least one of said first and second horizontal ends;

a second fixing hole for flush-type mounting being defined through at least one of said first and second horizontal ends;

a first engaging portion depending downwardly from said second vertical end and configured for engagement with a vertical surface of the case in the exposed-type mounting position;

a second engaging portion depending downwardly from said second vertical end and configured for engagement with a vertical surface of the case in the flush-type mounting position;

wherein when said terminal board assembly is mounted to the case of the control device in the exposed-type mounting position, said first vertical end of said terminal board is exposed relative to said top surface of the case when viewed from a front portion of the control device, and said terminal board is cooperatively fixed to the case by mating engagement between said first engaging portion and said vertical surface and by a fixing member engaged with the case and said first fixing hole;

wherein when said terminal board assembly is mounted to the case of the control device in the flush-type mounting position, said first vertical end of said terminal board is generally flush with said top surface of the case when viewed from a front portion of the control device, and said terminal board is cooperatively fixed to the case by mating engagement between said second engagement portion and said vertical surface and by a fixing member engaged with the case and said second fixing hole.

* * * * *

UNITED STATES PATENT AND TRADEMARK OFFICE

CERTIFICATE OF CORRECTION

PATENT NO. : 5,966,295
DATED : October 12, 1999
INVENTOR(S) : Hwan Ki Park

It is certified that error appears in the above-identified patent and that said Letters Patent is hereby corrected as shown below:

Column 3, line 9, after "turning" insert --inside out, and putting in again to assemble.

Namely, to change the flush type into the exposure type, apply reversely the sequences for changing the exposure type into the flush type as shown on and stated in Fig. 4. Then, it becomes the exposure type of control device as shown on Fig. 2(B).

As described in the aforesaid, the convertible a flush or exposure type terminal board of control device according to the present invention comprises an integrated structure enabling to easily convert into a flush type or an exposure type by using two bolts being fastened to the main body of terminal board, wherein wiring connection of input and output is convenient and can be simply used according to its uses.--.

Signed and Sealed this

Twenty-sixth Day of December, 2000

*Attest:*

Q. TODD DICKINSON

*Attesting Officer*

*Director of Patents and Trademarks*